US005938545A

United States Patent [19]

Cooper et al.

[11] Patent Number: 5,938,545

[45] Date of Patent: Aug. 17, 1999

[54] VIDEO SYSTEM FOR DETERMINING A LOCATION OF A BODY IN FLIGHT

[75] Inventors: Guy F. Cooper; Mark Leach, both of Ventura, Calif.

[73] Assignee: The United States of America as represented by the Secretary of the Navy, Washington, D.C.

[21] Appl. No.: 08/869,932

[22] Filed: Jun. 5, 1997

[51] Int. Cl.[6] ..... A63B 57/00

[52] U.S. Cl. ..... 473/407

[58] Field of Search ..... 473/409, 407, 473/199, 152, 151, 150

[56] References Cited

U.S. PATENT DOCUMENTS

| | | | |
|---|---|---|---|
| 5,303,924 | 4/1994 | Kluttz et al. | 473/409 X |
| 5,472,205 | 12/1995 | Bouton | 473/407 X |
| 5,846,139 | 12/1998 | Bair et al. | 473/152 X |
| 5,879,246 | 3/1999 | Gebhardt et al. | 473/409 |

*Primary Examiner*—Michael O'Neill

*Attorney, Agent, or Firm*—David S. Kalmbaugh

[57] ABSTRACT

A video system, comprising a pair of digital video cameras and a data processing system, which is used to determine the location of a golf ball during flight and the location of the golf ball when its flight is completed. The video cameras are fixedly mounted on a golf cart and boresighted to insure that the field of view for one camera overlaps the field of view for the other camera allowing the golf ball to be tracked after the golf ball is struck by the golfer. Each of the video cameras has an image array comprising a plurality of image sensing elements. As the golf ball travels along its flight path a light image of the golf ball is detected by at least one of the image sensing elements of the image array for each camera during a scan of the camera's image array. Each camera generates a data bit stream indicating the location of the image sensing elements on the image array which sense the golf ball's light image for each scan of the image array. The data bit streams are supplied to the data processing system which then calculates the departure vector, a trajectory path and a circular impact probability (CIP) location for the golf ball when the golf ball lands on the golf course. A monitor provides the golfer with video data indicating the golf ball's circular impact probability location.

10 Claims, 5 Drawing Sheets

VIDEO SYSTEM FOR DETERMINING A LOCATION OF A BODY IN FLIGHT

BACKGROUND OF THE INVENTION

1. Field of the Invention

The present invention relates generally to means for determining a location for a body, such as a golf ball, in flight. More specifically, the present invention is concerned with a video system, comprising a pair of video cameras and computer, which is used to determine the location of a body, such as the golf ball, which is in flight and the location of the body when its flight is completed.

2. Description of the Prior Art

When playing golf, amateur golfers will occasionally strike a golf ball and miss hit the golf ball which will often result in the golf ball landing in rough terrain such as high grass or a wooded area at a considerable distance from the golfer. This may result in the golfer being unable to locate the golf ball which will necessitate penalty shots to the golfer's score and the loss of a golf ball. Since a golfer who is not skilled at the game of golf may lose several golf balls during an eighteen hole round of golf and golf balls are relatively expensive it is desirable to provide a system to estimate the probable location of a lost golf ball in rough terrain.

In addition, the time the golfer spends looking for the lost golf ball will often result in delays for other golfers playing behind the golfer with the lost golf ball. Since golf courses are generally crowded this type of delay may result in some golfers being unable to complete their round of golf or even start their round of golf.

SUMMARY OF THE INVENTION

According to the present invention, briefly stated, there is provided a video system, comprising a pair of digital video cameras and data processing system, which is used to determine the location of a body, such as the golf ball, which is in flight and the location of the body when its flight is completed. The pair of digital video cameras are fixedly mounted on a golf cart. The digital video cameras are boresighted to insure that the field of view for one camera overlaps the field of view for the other camera allowing the golf ball to be tracked after the golf ball is struck by the golfer.

Each of the digital video cameras has an image array comprising a plurality of image sensing elements. As the golf ball travels along its flight path a light image of the golf ball is detected by at least one of the plurality of image sensing elements of the image array for each camera during a scan of the camera's image array. Each camera generates a digital data bit stream indicating the location of the pixels on the image array which sense the golf ball's light image for each scan of the image array. The data bit streams are supplied to the data processing system which then calculates the departure vector for the golf ball, a trajectory path for the golf ball and a circular impact probability (CIP) location for the golf ball when the golf ball lands on the golf course. Two scans to five scans of the image array of each digital video camera are required for the calculation of the golf ball's trajectory path and the circular impact probability location and its size. A monitor provides the golfer with video data indicating the golf ball's circular impact probability location and its size which enables the golfer to locate the golf ball. In addition, the video data provided by the monitor may be used by the golfer as a training aid to improve his stroke.

DETAILED DESCRIPTION OF THE PREFERRED EMBODIMENT

Figure 1:
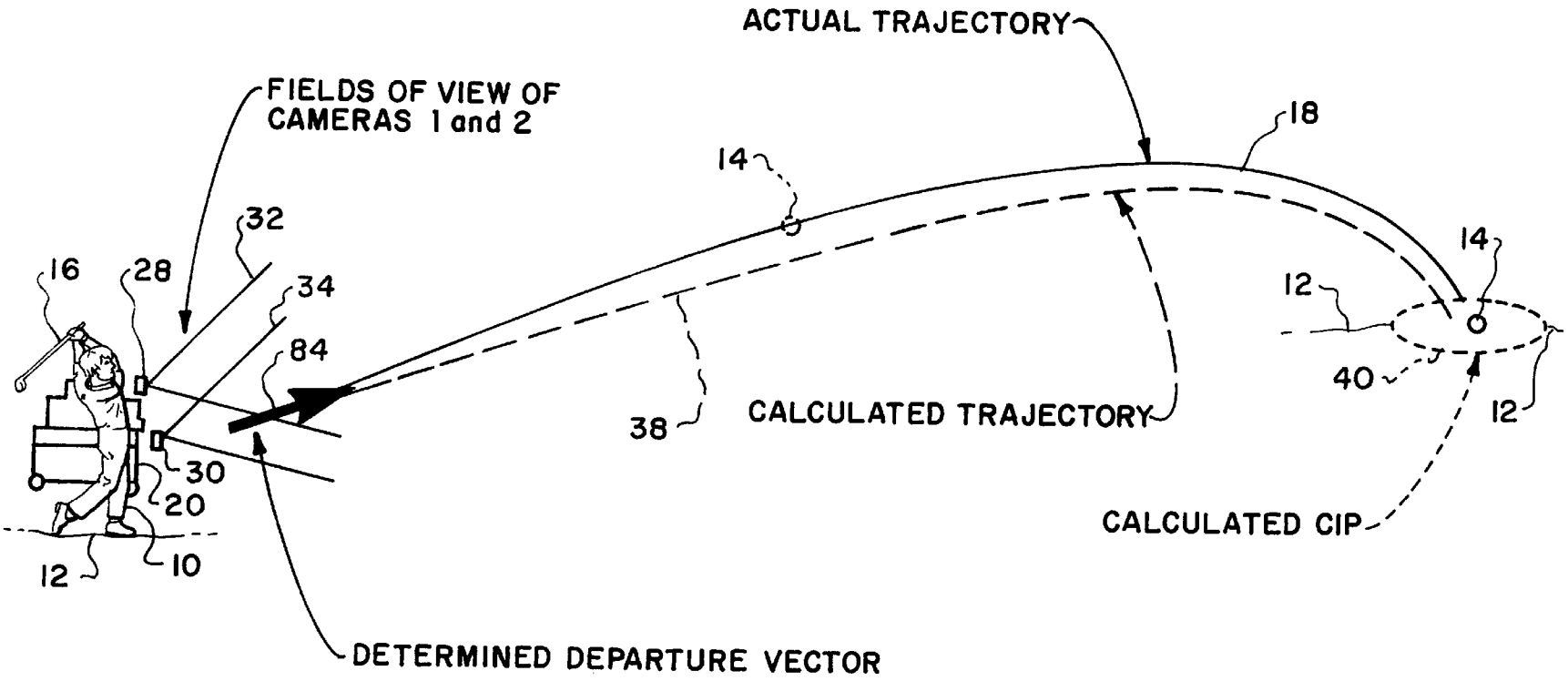
FIG. 1 illustrates the flight of a golf ball for which the departure vector is to be determined after the golf ball is struck by a golfer.
Figure 2:
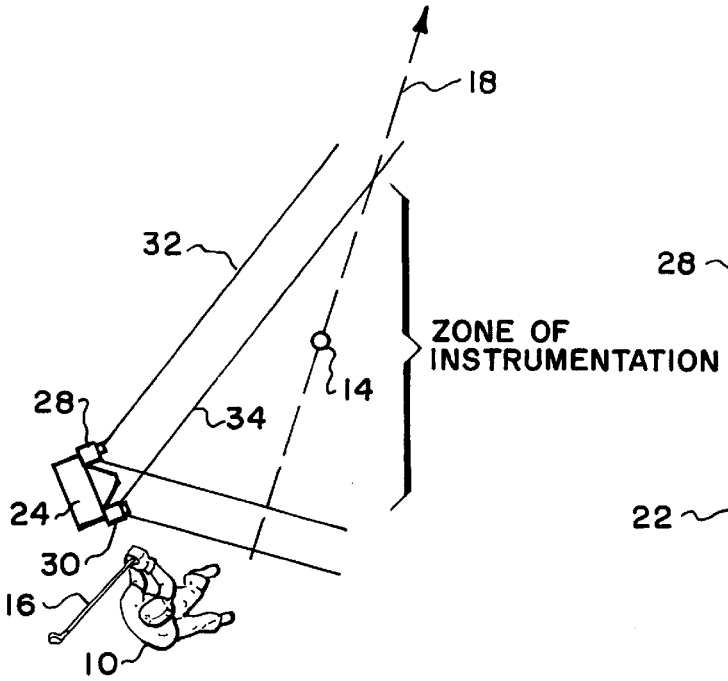
FIG. 2 is a top view of FIG. 1 illustrating the golfer striking a golf ball and the zone of instrumentation of the video cameras of the present invention.

Referring to FIGS. 1 and 2, there is shown a golfer 10 standing on a golf course 12 striking a golf ball 14 with a golf club 16. After golfer 10 strikes golf ball 14 with club 16, golf ball 14 will travel a trajectory or path 18 through the atmosphere until landing on the golf course 12 at a considerable distance from golfer 10. In the event that the golf ball 14 lands in rough terrain such as high grass or a wooded area, golfer 10 may not be able to locate golf ball 14.

Figure 3:
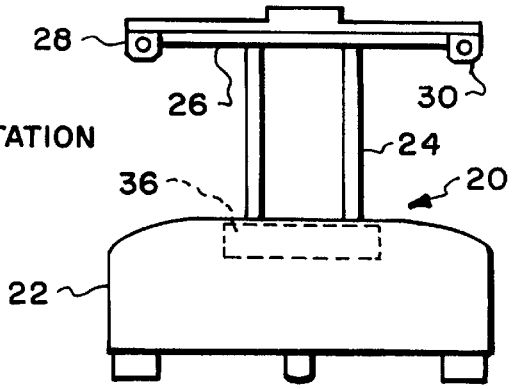
FIG. 3 illustrates a golf cart upon which the video cameras of the present invention are mounted.

Referring now to FIGS. 1, 2 and 3, there is shown a mobile golf cart 20 which includes a body 22 and a T shaped camera support structure 24 mounted vertically on a top portion of body 22 of golf cart 20. Support structure 24 has fixedly mounted on its underside 26 a pair of digital video cameras 28 and 30 which track golf ball 14 as golf ball 14 travels path 18 prior to landing on golf course 12.

As depicted in FIGS. 1 and 2, camera 28 has a field of view 32 and camera 30 has a field of view 34 for tracking golf ball 14 while golf ball 14 travels path 18 prior to landing on golf course 12. While golf ball 14 travels path 18, cameras 28 and 30 receives light images of golf ball 14.

Figure 6:
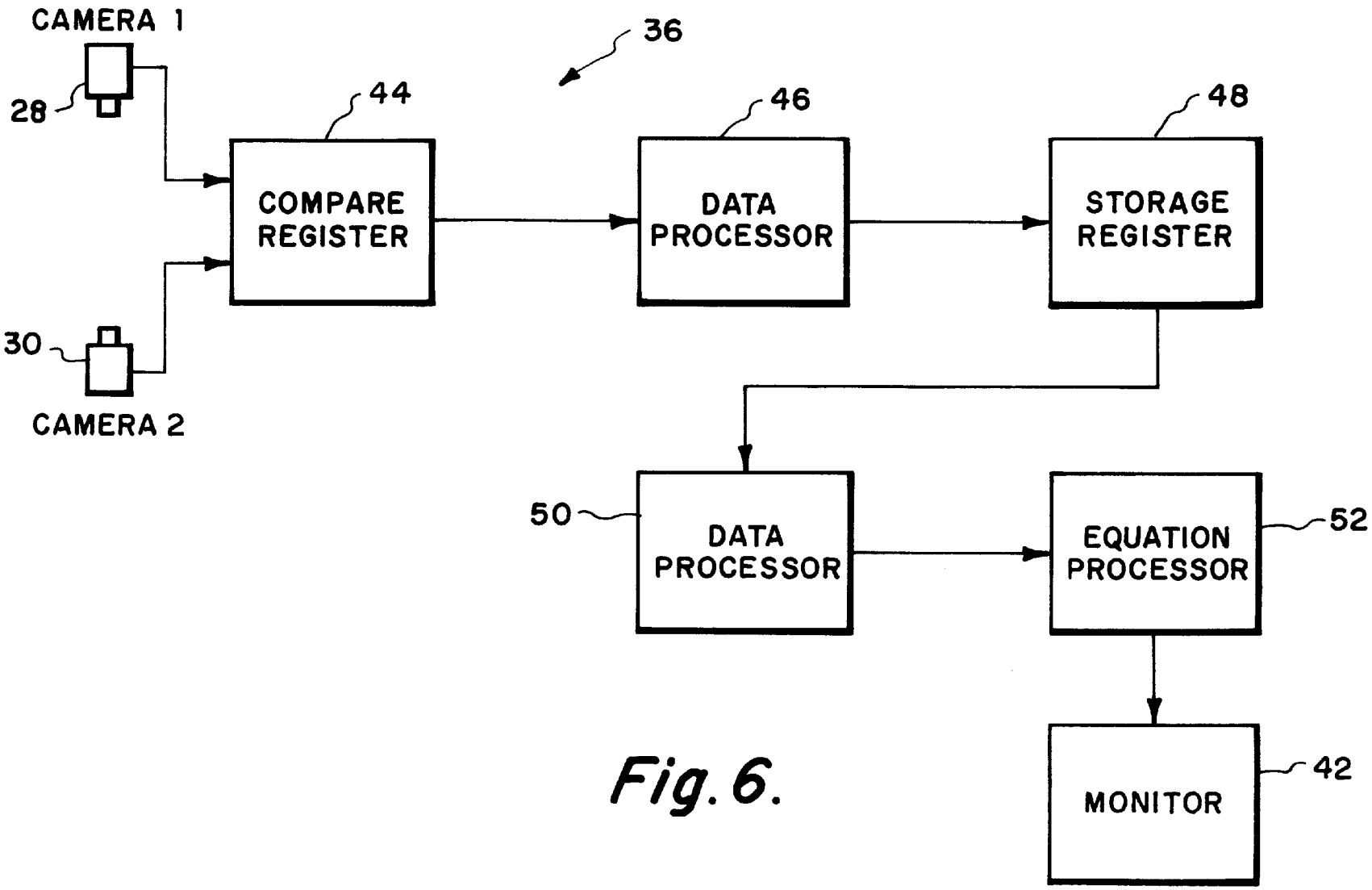
FIG. 6 illustrates a preferred embodiment of the video system of the present invention for determining a departure vector for a golf ball in flight.

Each camera 28 and 30 converts the light images of golf ball 14 to equivalent electrical signals and then supplies the electrical signals to a data processing system 36 which is illustrated in FIG. 6. Data processing system 36 then calculates a trajectory or path 38 which it estimates golf ball 14 will travel prior to landing on golf course 12 at a circular impact probability location 40. Data processing system 36 includes a monitor 42 mounted on golf cart 20 for providing video data to golfer 10. The video data provided to golfer 10 via monitor 42, which may be a television monitor, indicates the calculated location 40 where golf ball 14 lands on golf course 12. This video data allows golfer 10 to locate golf ball 14 whenever golf ball 14 lands in high grass or wooded areas of the golf course 12.

Referring to FIGS. 1 and 6, data processing system 36 includes video cameras 28 and 30 each of which is connected to a compare register 44 with the output of compare register being connected to a data processor 46. The output of data processor 46 is connected to a storage register 48 which is, in turn, connected to a data processor 50. The output of data processor 50 is connected to an equation processor 52 which has its output connected to monitor 42.

Referring to FIGS. 1 and 3, there is shown a planar image array 54 for each of the video cameras 28 and 30 of system 36. Planar image array 54 includes a plurality of image sensing elements 56 or pixels which receive light images of golf ball 14 as golf ball 14 travels along path 18 towards location 40. Each video camera 28 and 30 also has an objective lens 58, positioned on the video camera's optical axis 60 for receiving light images of golf ball 14. The objective lens 58 for each video camera 28 and 30 then direct the light images of golf ball 14 through a nodal point 62 of the camera to one of the plurality of image sensing elements 56 of the camera. For example, the light image of golf ball 14 when ball 14 is located at a position P1 is directed by lens 58 to an image sensing element 56 which is designated as 3,*c* on image array 54. In a like manner, the light image of golf ball 14 when ball 14 is located at a position P2 is direct by lens 58 to an image array 54 which is designated as 4,*d* on image array 54.

Figure 7:
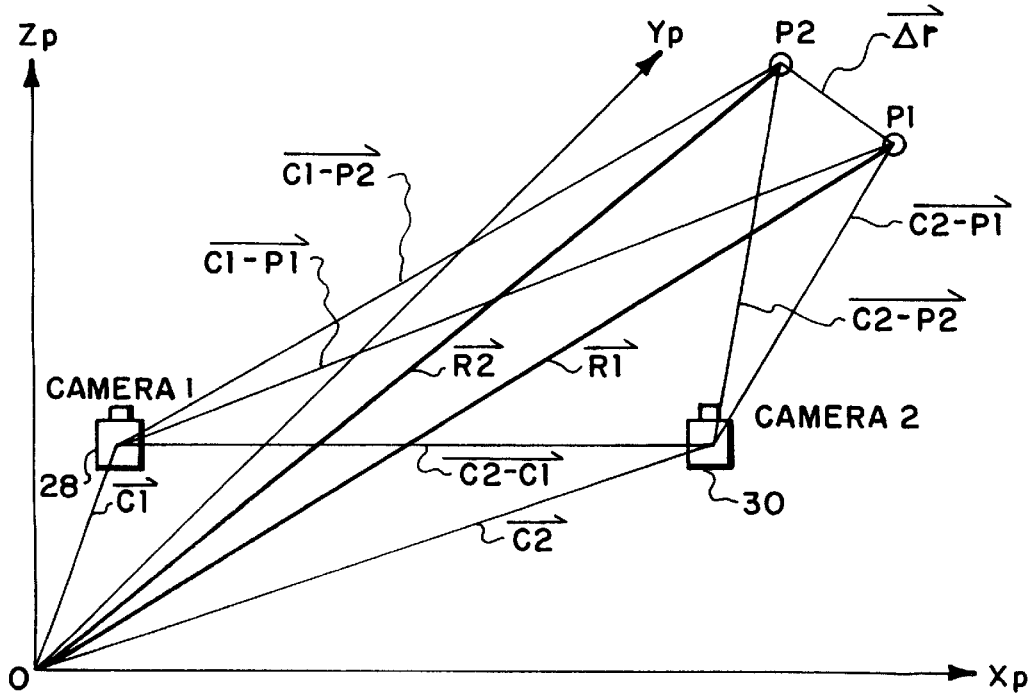
FIG. 7 illustrates a X-Y-Z coordinate system which is used in determining the position vectors of the golf ball at a position P1 and a position P2.

The operation of the present invention will now be discussed with reference to all of the Figures of the drawings. Cameras 28 and 30 provide a stereo vision of golf ball 14 as golf ball 14 travels along path 18 prior to landing on golf course 12. This allows the position of the departing golf ball 14 to be calculated immediately after being struck. The method by which the position of golf ball 14 is determined is triangulation relative to a golf cart $X_p$-$Y_p$-$Z_p$ coordinate system (FIG. 7) in which cameras 28 and 30 are located. By using digital video cameras as cameras 28 and 30 the data bit streams, which represent the light or visible images of golf ball 14 detected by cameras 28 and 30, comprise departure direction data for golf ball 14 as cameras 28 and 30 track golf ball 14 during its flight along path 18.

At this time it should be noted that the video system of the present invention may also be used to track an infrared signature for an object in flight when infrared cameras are used as cameras 28 and 30.

Referring to FIGS. 1, 4, 5 and 7, there is shown the relative position of video cameras 28 and 30 of the present invention when fixedly mounted on the golf cart 20 of FIG. 3. The distance between cameras 28 and 30 (identified as base line 29) is set at a predetermined distance. The distance R1 a light image travels from golf ball 14 to camera 28 and the distance R2 a light image travels from golf ball 14 to camera 30 may also be determined for each position P1 and P2 of golf ball 14 as golf ball 14 travels along path 14. The intersection of R1 and R2 establishes a first triangle (as illustrated in FIG. 6) in the golf cart $X_p$-$Y_p$-$Z_p$ coordinate system of the type illustrated in FIG. 7. At a time interval $\Delta t$ after position P1 is establish, golf ball 14 travels to a new position P2 which results in a second triangle being formed. The positional difference or difference vector Ar between position P1 and position P2 for golf ball 14 divided by the time interval $\Delta t$ provides a velocity vector V in the golf cart $X_p$-$Y_p$-$Z_p$ coordinate system of FIG. 7 for golf ball 14 as golf ball 14 travels path 18.

The identification of a particular image sensing element 56 on planar image array 54 for each of the video cameras 28 and 30 is determined by a comparison of the camera's digital data bit stream for one frame scan with the data bit stream of a proceeding frame scan. Since generally the only light image moving in field of view 32 for camera 28 and field of view 34 for camera 30 is the light image of golf ball 14, all image sensing elements 56 will remain the same from one scan of image array 54 to a subsequent scan of image array 54 except for the image sensing elements 56 which receives a light image of golf ball 14. This allows the direction of golf ball 14 with respect to video cameras 28 and 30 at positions P1 and P2 to be determined.

In order to locate the circular impact probability location 40 where golf ball 14 will land on golf course 12, the direction of movement of golf ball 14 must first be determined. This, in turn, requires that angle 72 and angle 74 illustrated in FIG. 5 be calculated.

Boresighting the optical axis 60 for each camera 28 and 30 insures that field of view 32 overlaps field of view 34 allowing the golf ball 14 to be tracked when it is first struck by golf club 16 and also angles 72 and 74. When camera 28 is boresighted the angle between the optical axis 60 for camera 28 and base line 29 may be determined and will remain fixed. Similarly, when camera 30 is boresighted the angle between the optical axis 60 for camera 30 and base line 29 may be determined and will remain fixed.

Figure 4:
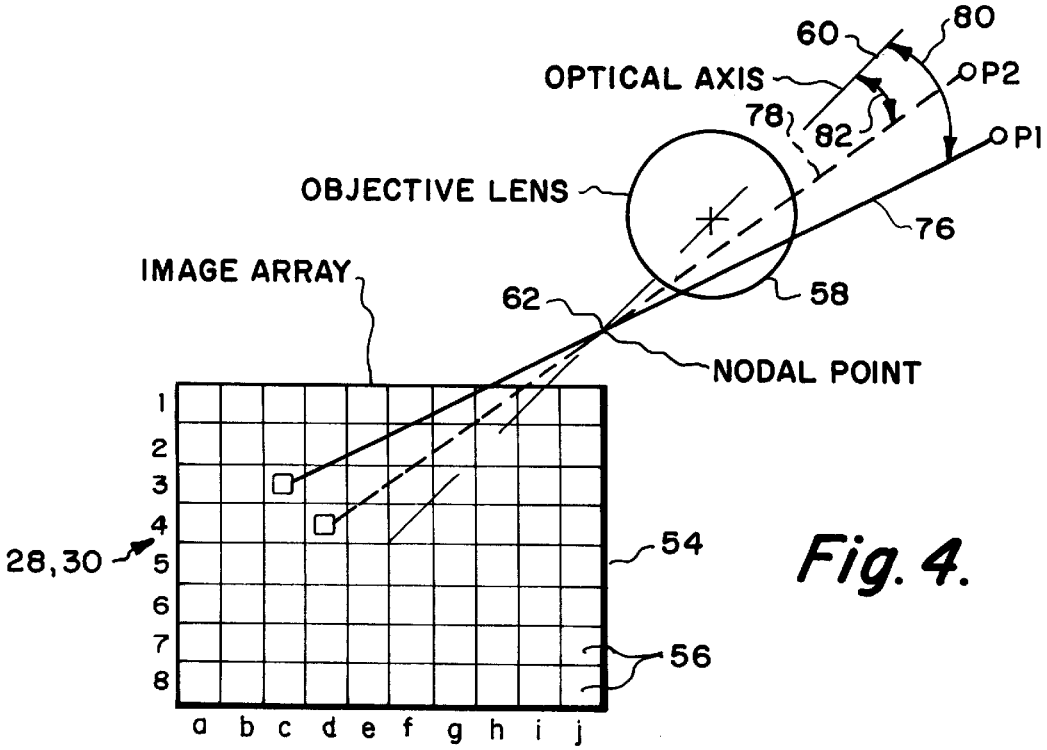
FIG. 4 illustrates a camera image array for one of the cameras of FIG. 1 wherein a pair of image receiving elements of the array receive an image of the golf ball for successive positions of the golf ball while in flight.
Figure 5:
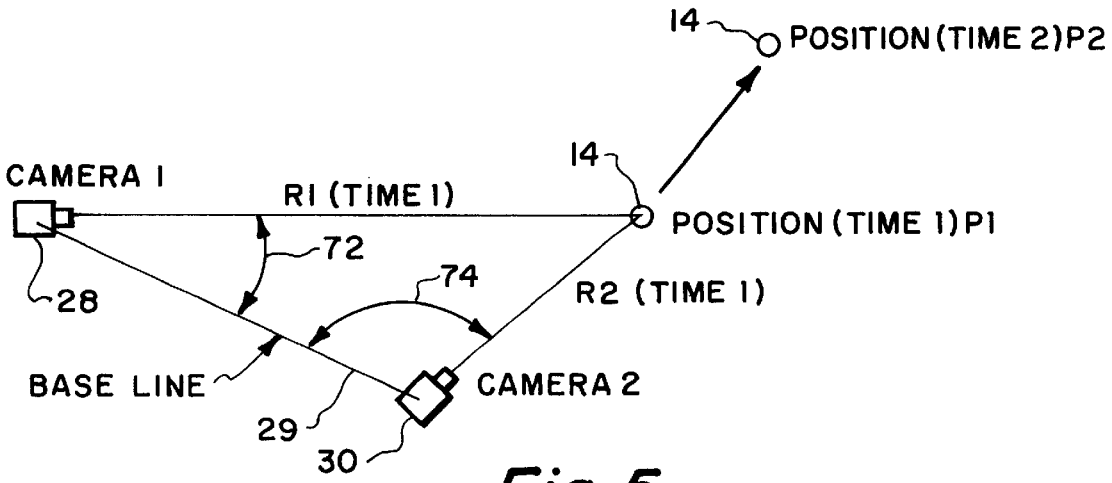
FIG. 5 illustrates the relative position of the video cameras of the present invention when mounted on the golf cart of FIG. 3.

The following discussion is with respect to camera 28 although it should be understand that this discussion also applies to camera 30. As depicted in FIG. 4, when golf ball 14 is at position P1, the image sensing element 56 (located at position 3,*c* on array 54) receives the light image of golf ball 14 at position P1. The angle 80 between optical axis 60 and optical path 76 is then determined from the digital data bit stream provided by image array 54 of camera 28 to data processing system 36 (FIG. 6). Angle 74 is next calculated by adding angle 80 to the angle between the optical axis 60 for camera 28 and base line 29 which is set when camera 28 was boresighted. In a like manner, when golf ball 14 is at position P1, angle 72 is calculated by analyzing the data bit stream provided by the image array 54 for camera 30 which indicates the particular image sensing element 56 upon which the light image of golf ball 14 is incident. Since the angles 72 and 74 are now known and the base line 29 is set at a predetermined distance, the distance R1 and the distance R2 may be calculated by data processing system 36. Data processing system 36 next determines the x, y, z coordinate position (FIG. 7) of golf ball 14 when golf ball 14 is at position P1.

When golf ball 14 is at position P2, the image sensing element 56 (located at position 4,*d* on array 54) receives the light image of golf ball 14 at position P2. The angle 82 between optical axis 60 and optical path 78 is then calculated from the data bit stream provided by image array 54 of camera 28 to data processing system 36 (FIG. 6). After the angle 82 is calculated for each of the cameras 28 and 30, data processing system 36 determines the x, y, z coordinate position (FIG. 7) of golf ball 14 when golf ball 14 is at position P2 in exactly the same manner that data processing system 36 determined the x, y, z coordinate position (FIG. 7) of golf ball 14 when golf ball 14 was at position P1. The calculation of position P1 and position P2 allows system 36 to determine and then provide azimuth and elevation data to golfer 10 via monitor 42.

A third, fourth or even a fifth scan of the image arrays 54 of each camera 28 and 30 may be required to accurately determine the direction of the golf ball's motion as golf ball 14 travels along path 18. Factors effecting the number of scans required to calculate the trajectory or path 38, which data processing system 36 estimates golf ball 14 will travel prior to landing on golf course 12 at circular impact probability location 40, include false targets generated by system signal to noise ratio or optical resolving power and other objects appearing in the background.

Digital video cameras, such as cameras 28 and 30 generally scan their image arrays 54 at a rate of thirty frames per second, that is a scan of the image sensing elements 56 or pixels of image array 54 requires one thirtieth of a second to complete. The resolution required to track golf ball 14 for three frames as golf ball 14 travels along path 18 at 400 ft/sec is given by the following equation:

$$d_i = \frac{R_i d_b}{R_b} \tag{1}$$

Where:

$d_i$=Diameter of the ball's image on the image plane $R_i$=Distance from nodal point to image plane $d_i$=Diameter of the ball $R_b$=Range from nodal point to the ball in flight For a golf ball 14 having a diameter of 1.66 inches, traveling a distance of 40 feet and assuming a 2 inch distance from nodal point 60 to the image plane for array 54, the image diameter for golf ball 14 will be approximately 0.007 inches. This diameter for the light image of golf ball 14 is sufficient to allow one image sensing element 56 or pixel of array 54 of most of the commercially available high resolution charge coupled device digital cameras to detect the golf ball 14. At the two preceding positions for golf ball 14 as golf ball 14 travels path 18, the image diameter for golf ball 14 provided to image array 54 is respectively 0.010 inches and 0.021 inches. This results in the light image of golf ball 14 being detected by more than one of the image sensing elements 56 of image array 54. The computer software used by data processing system 36 distinguishes the image sensing elements 56 which detect the light image of golf ball 14 identifying the centrally located element 56 which represents the central portion of the golf ball 14. For example, when image sensing elements 56 located at positions 4,*c*; 4,*d*; 4,*e*; 3,*d*; and 5,*d* on image array 54 detect the light image of golf ball 14, data processing system 36 can identify the centrally located element 56 at position 4,*d* of array 54 which represents the central portion of golf ball 14.

Referring to FIGS. 1 and 6, camera 28 and camera 30 first supply their respective data bit streams to a register 44 for each scan by cameras 28 and 30 of golf ball 14. Register 44 compares the data bit streams for camera 28 and camera 30 to insure that the data bit streams are in synchronism and also provide the required data for determining the position of golf ball 14 during each scan by cameras 28 and 30 of the flight of golf ball 14 along path 18. The data bit streams for each camera 28 and 30 are next supplied to a data processor 46 which determines the location of golf ball 14 in the coordinate system of FIG. 7 for each scan by cameras 28 and 30 of golf ball 14. The x, y, z coordinate location of golf ball 14 for the first, second and subsequent positions (as many as five x, y, z coordinate locations) of golf ball 14 as golf ball 14 travels along path 18 are stored in storage register 48.

This positional information is next provided to a storage register which stores the positional information for use by data processor 50. Data processor 50 next computes the departure vector 84 for golf ball 14 when golf ball 14 is struck by golf club 16. An electrical data signal, representative of departure vector 84, is supplied to an equation processor 52. Equation processor 52, responsive to this electrical signal, calculates the trajectory or path 38 which it estimates golf ball 14 will travel prior to landing on golf course 12 at a circular impact probability location 40. In addition, equation processor 52 also calculates the circular impact probability location 40 and its size or dimensions.

Any of several well known techniques may be used to calculate circular impact probability location 40 such as the montecarlo method of incorporating expected errors. In addition, it should be noted that the termination point of calculated trajectory 38 is at the center of circular impact probability location 40.

Monitor 42 provides video data to golfer 10 indicating the calculated trajectory or path 38 for golf ball 14 and the circular impact probability location 40 for golf ball 14 when golf ball 14 lands on golf course 12. This indicates to golfer 10 the probable location of golf ball 14 enabling golfer 14 to retrieve golf ball 14 in the event golf ball 14 in rough terrain such as high grass or a wooded area on golf course 12.

Figure 8:
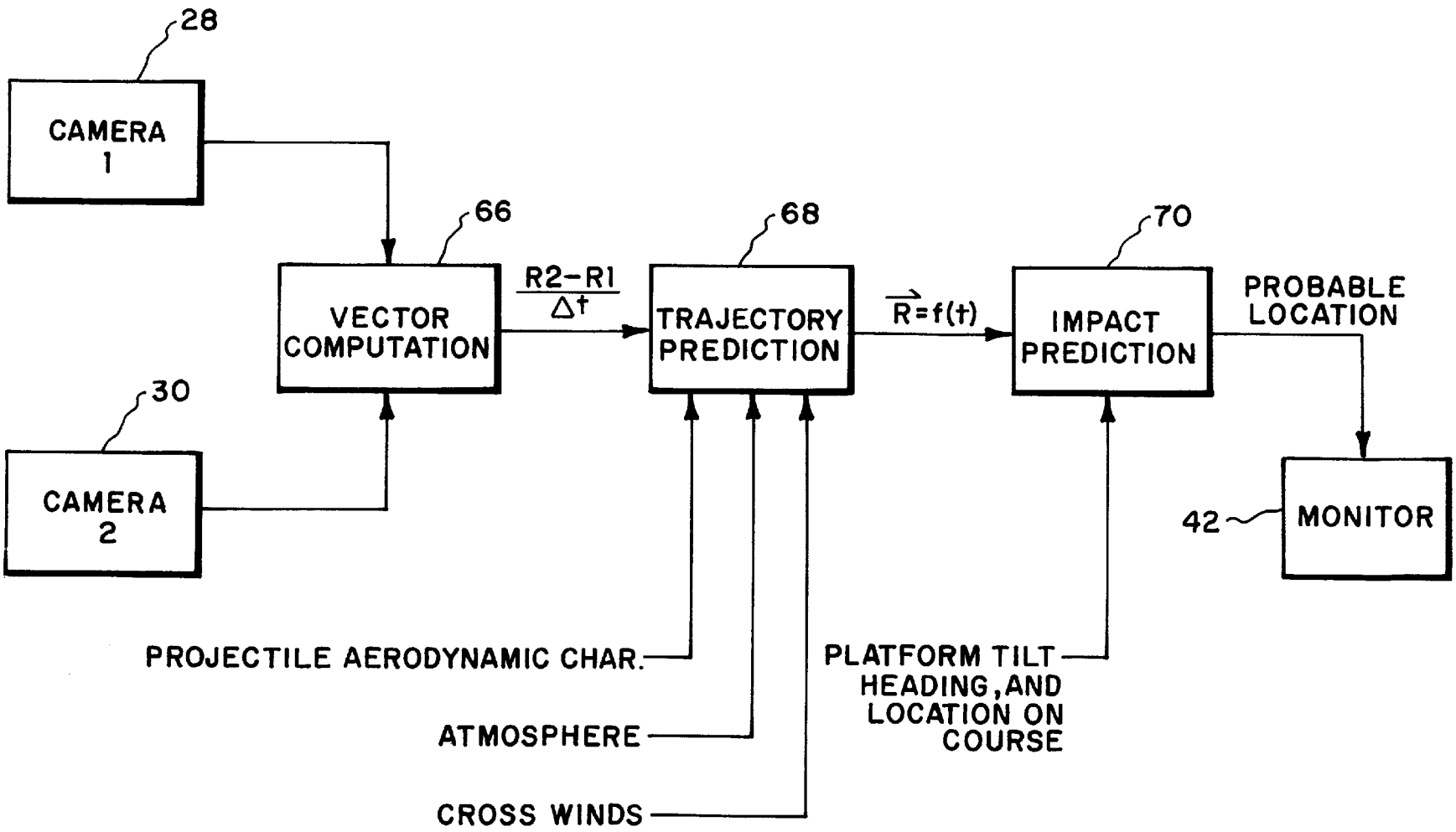
FIG. 8 is a flow diagram illustrating the steps used to compute the golf ball's trajectory and probable impact location on a golf course.

FIG. 8 illustrates a flow diagram which describes the steps 66, 68 and 70 used by the computer software for data processing system 36 to compute the golf ball's trajectory and probable impact point on a golf course 12. Step 66 computes the departure vector 38 in the golf cart $X_p$-$Y_p$-$Z_p$ coordinate system of FIG. 7 , step 68 calculates the trajectory 38 for golf ball 14 and step 70 calculates the circular impact probability location 40 in the golf cart $X_p$-$Y_p$-$Z_p$ coordinate system for golf ball 14 when golf ball 14 land on golf course 12. It should be noted that a coordinate transformation is required and is processed by system 36 from the coordinate system of FIG. 7 to a coordinate system for locating golf ball 14 on golf course 12. The display of video data on monitor 42 is in the golf course 12 X-Y-Z coordinate system.

From the foregoing description, it may readily be seen that the present invention comprises a new, unique and exceedingly useful video system for determining a location of a golf ball in flight and its probable location at the completion of its flight which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A video system for tracking a golf ball traveling on a flight path through the atmosphere and for locating said golf ball on a golf course when said golf ball lands on said golf course, said video system comprising:

a mobile vehicle having a body and a T shaped support structure mounted vertically on a top portion of the body of said mobile vehicle;

first and second digital cameras mounted on an underside of said T shaped support structure, each of said first and second digital cameras having a field of view, the field of view of said first digital camera and the field of view of said second digital camera having an overlapping portion wherein the field of view of said first digital camera overlaps the field of view of said second digital camera;

said first and second digital cameras being boresighted to track said golf ball when said golf ball is traveling on said flight path within the overlapping portion of the fields of view of said first and second digital cameras;

said first digital camera having an image array for receiving first and second light images of said golf ball traveling on said flight path when said golf ball is within the overlapping portion of the fields of view of said first and second digital cameras;

said second digital camera having an image array for receiving said first and second light images of said golf ball traveling on said flight path when said golf ball is within the overlapping portion of the fields of view of said first and second digital cameras;

said first digital camera generating a first digital data bit stream indicative of a first position of the first light image of said golf ball and a second position of the second light image of said golf ball received by the image array of said first digital camera;

said second digital camera generating a second digital data bit stream indicative of said first position of the first light image of said golf ball and said second position of the second light image of said golf ball received by the image array of said second digital camera;

data processing means coupled to said first and second digital cameras to receive said first digital data bit stream and said second digital data bit stream, said data processing means processing said first digital data bit stream and said second digital data bit stream to determine a circular impact probability location for said golf ball when said golf ball lands on said golf course; and data display means connected to said data processing means, said data display means displaying visual data of said circular impact probability location where said golf ball landed on said golf course.

2. The video system of claim 1 wherein said mobile vehicle comprises a golf cart.

3. The video system of claim 1 wherein the image array of said first digital camera comprises a plurality of image sensing elements for receiving said first and second light images of said golf ball traveling on said flight path when said golf ball is within the overlapping portion of the fields of view of said first and second digital cameras.

4. The video system of claim 1 wherein the image array of said second digital camera comprises a plurality of image sensing elements for receiving said first and second light images of said golf ball traveling on said flight path when said golf ball is within the overlapping portion of the fields of view of said first and second digital cameras.

5. The video system of claim 1 wherein said processing means comprises:

a compare register having a first input connected to said first digital camera, a second input connected to said second digital camera and an output;

a first data processor having an input connected to the output of said compare register and an output;

a storage register having an input connected to the output of said first data processor and an output;

a second data processor having an input connected to the output of said storage register and an output; and an equation processor having an input connected to the output of said second data processor and an output connected to said monitor.

6. The video display system of claim 1 wherein said data display means comprises a television monitor mounted on said mobile vehicle.

7. A video system for tracking a golf ball traveling on a flight path through the atmosphere and for locating said golf ball on a golf course when said golf ball lands on said golf course, said video system comprising:

a mobile vehicle having a body and a T shaped support structure mounted vertically on a top portion of the body of said mobile vehicle;

first and second digital cameras mounted on an underside of said T shaped support structure, each of said first and second digital cameras having a field of view, the field of view of said first digital camera and the field of view of said second digital camera having an overlapping portion wherein the field of view of said first digital camera overlaps the field of view of said second digital camera;

said first and second digital cameras being boresighted to track said golf ball when said golf ball is traveling on said flight path within the overlapping portion of the fields of view of said first and second digital cameras;

said first digital camera having an image array comprising a plurality of image sensing elements, the image sensing elements of said first digital camera receiving first and second light images of said golf ball traveling on said flight path when said golf ball is within the overlapping portion of the fields of view of said first and second digital cameras;

said second digital camera having an image array comprising a plurality of image sensing elements, the image sensing elements of said second digital camera receiving said first and second light images of said golf ball traveling on said flight path when said golf ball is within the overlapping portion of fields of view of said first and second digital cameras;

said first digital camera generating a first digital data bit stream indicative of a first position of the first light image of said golf ball and a second position of the second light image of said golf ball received by the image sensing elements of said first digital camera;

said second digital camera generating a second digital data bit stream indicative of said first position of the first light image of said golf ball and said second position of the second light image of said golf ball received by the image sensing elements of said second digital camera;

a data processing system coupled to said first and second digital cameras to receive said first digital data bit stream and said second digital data bit stream, said data processing system processing said first digital data bit stream and said second digital data bit stream to determine a circular impact probability location for said golf ball when said golf ball lands on said golf course; and a monitor connected to said data processing system, said monitor being mounted on said mobile vehicle, said monitor providing visual data of said circular impact probability location where said golf ball landed on said golf course.

8. The video system of claim 7 wherein said mobile vehicle comprises a golf cart.

9. A video system for tracking a golf ball traveling on a flight path through the atmosphere and for locating said golf ball on a golf course when said golf ball lands on said golf course, said video system comprising:

a mobile vehicle having a body and a T shaped support structure mounted vertically on a top portion of the body of said mobile vehicle;

first and second digital cameras mounted on an underside of said T shaped support structure, each of said first and second digital cameras having a field of view, the field of view of said first digital camera and the field of view of said second digital camera having an overlapping portion wherein the field of view of said first digital camera overlaps the field of view of said second digital camera;

said first and second digital cameras being boresighted to track said golf ball when said golf ball is traveling on said flight path within the overlapping portion of the fields of view of said first and second digital cameras;

said first digital camera having an image array having a plurality of image sensing elements, the image sensing elements of said first digital camera receiving first and second light images of said golf ball traveling on said flight path when said golf ball is within the overlapping portion of the fields of view of said first and second digital cameras;

said second digital camera having an image array having a plurality of image sensing elements, the image sensing elements of said second digital camera receiving said first and second light images of said golf ball traveling on said flight path when said golf ball is within the overlapping portion of fields of view of said first and second digital cameras;

said first digital camera generating a first digital data bit stream indicative of a first position of the first light image of said golf ball and a second position of the second light image of said golf ball received by the image sensing elements of said first digital camera;

said second digital camera generating a second digital data bit stream indicative of said first position of the first light image of said golf ball and said second position of the second light image of said golf ball received by the image sensing elements of said second digital camera;

a data processing system coupled to said first and second digital cameras to receive said first digital data bit stream and said second digital data bit stream, said data processing system processing said first digital data bit stream and said second digital data bit stream to determine a circular impact probability location for said golf ball when said golf ball lands on said golf course;

a monitor connected to said data processing system, said monitor being mounted on said mobile vehicle, said monitor providing visual data of said circular impact probability location where said golf ball landed on said golf course;

said data processing system comprising:

a compare register having a first input connected to said first digital camera, a second input connected to said second digital camera and an output;

a first data processor having an input connected to the output of said compare register and an output;

a storage register having an input connected to the output of said first data processor and an output;

a second data processor having an input connected to the output of said storage register and an output; and an equation processor having an input connected to the output of said second data processor and an output connected to said monitor.

10. The video system of claim 9 wherein said mobile vehicle comprises a golf cart.

* * * * *